US006436552B1

(12) United States Patent
Walker et al.

(10) Patent No.: US 6,436,552 B1
(45) Date of Patent: Aug. 20, 2002

(54) STRUCTURAL METAL FRAMING MEMBER

(76) Inventors: Steven H. Walker, 2415 Chinook Trail, Maitland, FL (US) 32751; Raymond C. Frobosilo, 253 Blackheath Rd., Lido Beach, NY (US) 11561

( * ) Notice: Subject to any disclaimer, the term of this patent is extended or adjusted under 35 U.S.C. 154(b) by 0 days.

(21) Appl. No.: 09/975,845

(22) Filed: Oct. 12, 2001

Related U.S. Application Data

(60) Provisional application No. 60/240,384, filed on Oct. 16, 2000.

(51) Int. Cl.[7] ..... E04C 3/07; E04C 3/16

(52) U.S. Cl. ..... 428/598; 428/603; 52/729.5; 52/731.7; 52/731.9; 52/733.2; 52/733.3

(58) Field of Search ..... 428/586, 598, 428/603; 52/729.5, 731.9, 731.7, 733.2, 733.3

(56) References Cited

U.S. PATENT DOCUMENTS 991,603 A * 5/1911 Brooks ..... 52/364
5,535,569 A * 7/1996 Seccombe et al. ..... 52/634
5,553,437 A * 9/1996 Navon ..... 52/729.1
5,842,318 A * 12/1998 Bass et al. ..... 403/201
6,115,986 A * 9/2000 Kelly ..... 52/634
6,131,362 A * 10/2000 Buecker ..... 29/897.35
6,170,217 B1 * 1/2001 Meyer ..... 29/897.31

* cited by examiner

*Primary Examiner*—John J. Zimmerman
(74) *Attorney, Agent, or Firm*—Clifford G. Frayne

(57) ABSTRACT

A cold formed, elongate, steel metal structural member having a web portion having two longitudinally extending edges, there being a first tubular flange extending along one edge and projecting laterally to both sides of the web and a second tubular flange extending along the opposing edge and projecting laterally to one side only of the web, each of the tubular flange members having an elongate margin juxtaposed the web, one of the tubular flange members having its elongate margin secured to the web member.

4 Claims, 3 Drawing Sheets

STRUCTURAL METAL FRAMING MEMBER

RELATED APPLICATION

Applicant claims the benefit of provisional application Ser. No. 60/240,384, filed Oct. 16, 2000 for "Structural Metal Support Member".

BACKGROUND OF THE INVENTION

1. Field of the Invention

The present invention relates to elongate structural members for use in load bearing frames. More particularly the invention is concerned with structural members that are cold formed from sheet metal and utilized in triangulated frames wherein the rigidity of the frame as a whole results from the triangular arrangement of the members.

2. Description of the Prior Art

Elongate structural members that are cold formed from sheet metal are known in the art and are formed by example by rolling, folding or pressing a metal strip to achieve a cross section which is essentially either a channel, C-section, Z-section or I-section. These prior structural members are defined by a web having flanges projecting from the edges of the web and are formed from a steel strip of relatively thin dimension.

The structural members heretofore described have found wide spread usage as structural members in wall frames and roof trusses in dwellings such as sheds and small commercial buildings and the like. With the advent of increasing lumber costs, it has now become competitive that cold formed sheet metal structural members can be used in the construction of houses and other small buildings. This building industry is highly competitive and every effort is made to contain costs with respect to the structural members themselves and the manner in which they are formed into other structural members, such as roof truss. It is therefore desirable to have a cold form metal structural member that is easily fabricated and exhibits exceptional structural strength even when fabricated of relatively thin sheet metal so as to eliminate any catastrophic failures when the member is utilized to form other structural members.

OBJECTS OF THE INVENTION

An object of the present invention is to provide for a novel elongate, cold formed, metal structural member fabricated out of relatively thin sheet metal, yet exhibiting exceptional load bearing capacity.

A further object of the present invention is to provide for a novel elongate, cold formed, metal structural member which is easily manufactured and lends itself to efficient on cite assembly.

SUMMARY OF THE INVENTION

The invention comprises a cold formed, elongate, sheet metal structural member having a web portion having two longitudinally extending edges, there being a first tubular flange extending along one edge and projecting laterally to both sides of the web and a second tubular flange extending along the opposing edge and projecting laterally to one side only of the web, each of the tubular flange members having an elongate margin juxtaposed the web, one of the tubular flange members having its elongate margin secured to the web member.

BRIEF DESCRIPTION OF THE DRAWINGS

These and other objects of the present invention will become apparent, particularly when taken in light of the following illustrations wherein.

DETAILED DESCRIPTION OF THE DRAWINGS

Figure 1:
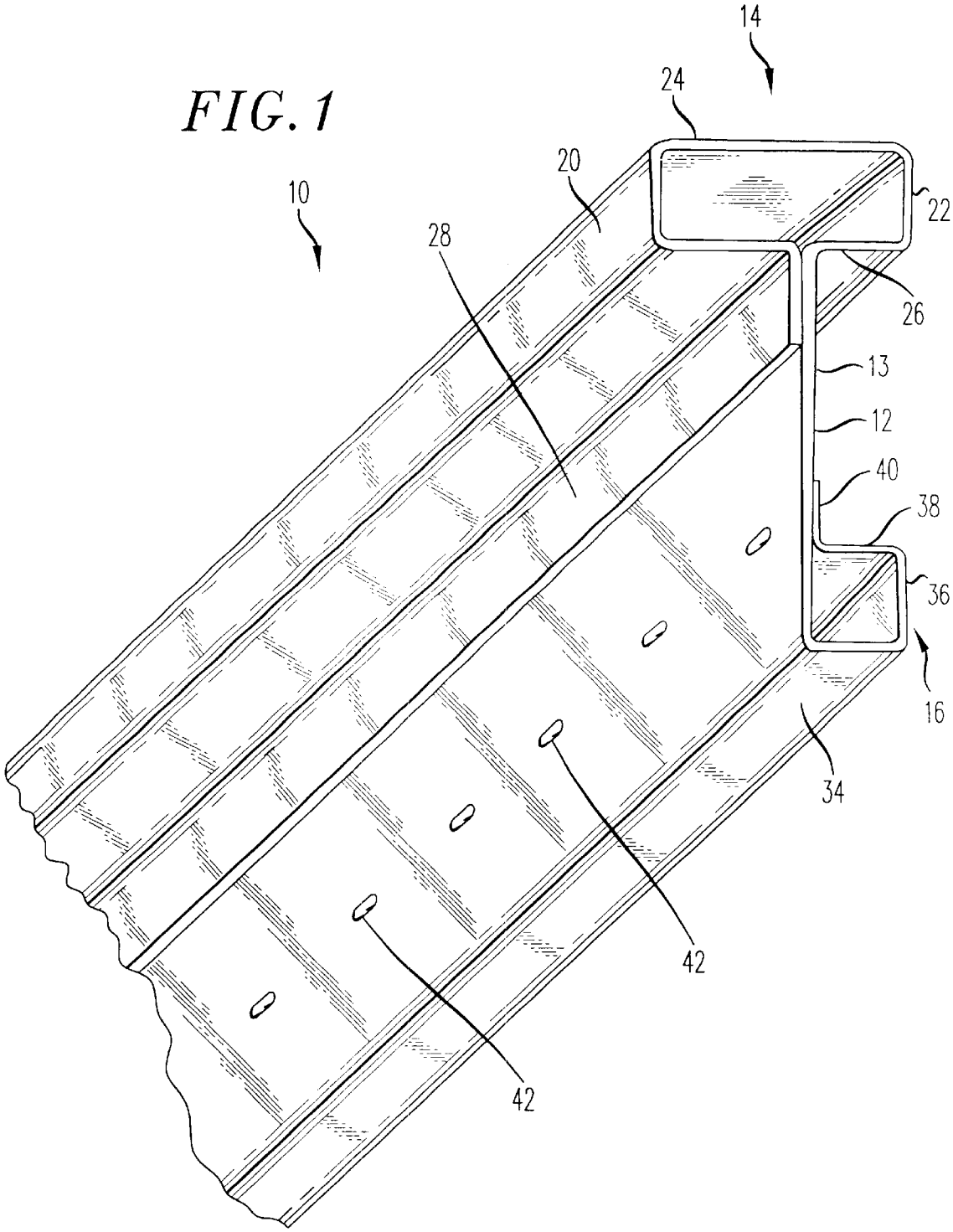
FIG. 1 is a partial prospective end view of the metal structural member.

The structural member illustrated in FIG. 1 may be roll formed from thin, high tensile, preferably galvanized steel in a range of from 0.4 millimeters to 1.2 millimeters. It can be roll formed by a single passage of an initially flat strip of appropriate width through a series of stands or dyes of forming rolls which successively modify the shape of the strip passing through.

The structural member 10 comprises a web 12, centrally disposed, having a first side 11 and second side 13, and having formed thereon, two hollow flanges 14 and 16 respectively. Flange 14 comprises a tubular body of rectangular cross section which projects laterally to both sides 11 and 13 of the web. Flange 14 is comprised of flange walls 20 and 22 which are substantially parallel with web 12, load bearing flange wall 24 and lower flange wall 26 which is integral with and perpendicular to web 12 on side 13 of web 12 and perpendicular to web 12 on opposing side 11 ending with a margin 28 juxtaposed against web 12.

Lower flange 16 projects to only one side, 13 of web 12 on the opposing edge of web 12. Flange 14 comprises a lower wall 34, side wall 36, and a top wall 38 which terminates with a margin 40 juxtaposed to the web and secured thereto by a plurality of fastening means 42.

Upper flange 14 which projects laterally to both sides 11 and 13 of web 12 projects approximately twice as far on side 11 as opposed to side 13 and lower flange 16 projects to side 13 a distance equal to the projection of flange 14 on side 13.

Figure 3:
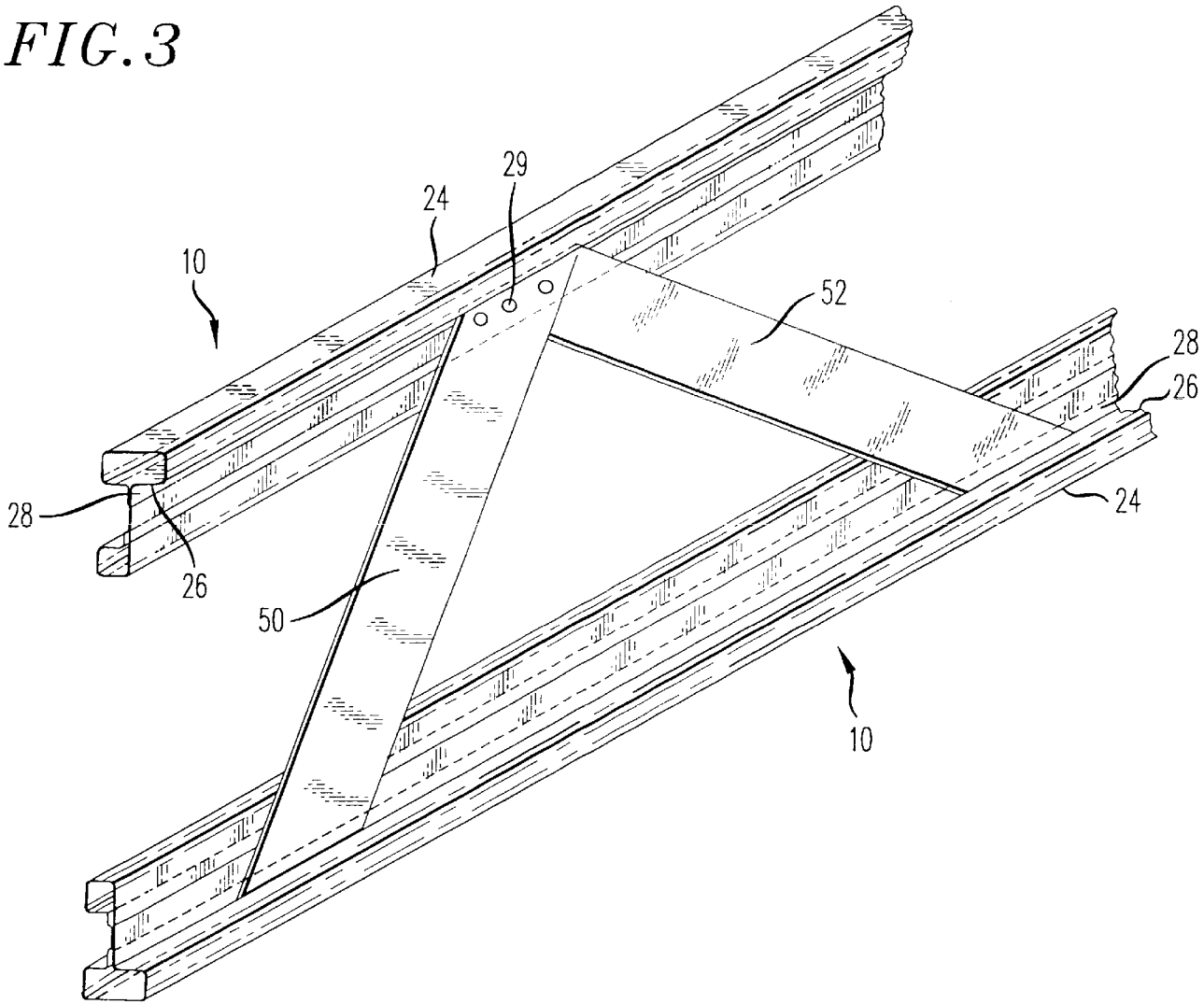
FIG. 3 is a partial perspective view of a truss member incorporating the metal structural member.

In the configuration described, structural metal member 10 is suitable for use as a cord in a floor joist or in a roof truss. In both uses, two identical structural members 10 would be disposed apart from each other and secured by a plurality of angled members. This is best illustrated in FIG. 3 which is a partial prospective of a floor joist wherein two of the structural metal members 10 as illustrated in FIG. 1 are positioned such that the load bearing wall 24 is positioned in opposing directions and intermediate structural members 50 and 52 are positioned therebetween on side 11 of web 12. Intermediate structural member 50 and 52 would be secured to the web 12 of structural members 10 by a suitable fastening means such as a rivet, screw or the like. In so fastening intermediate members 50 and 52 to the web 12 of structural member 10, the margin 28 of upper flange 14 would become fixed either by the passage therethrough of fastening means or the juxtaposition of the upper and lower members of intermediate members 50 against lower wall 26 of upper flange 14.

The configuration of structural member 10 provides for no sharp edges and a double walled, load bearing flange 14 which is more readily acceptable for nailing and the securing of nails as opposed to a single laminate metal wall. Still further the configuration allows for ease of packaging and shipping of structural members 10 and also the ease of shipping of roof trusses or floor joist which are prefabricated using structural members of the like of structural member 10.

Figure 2:
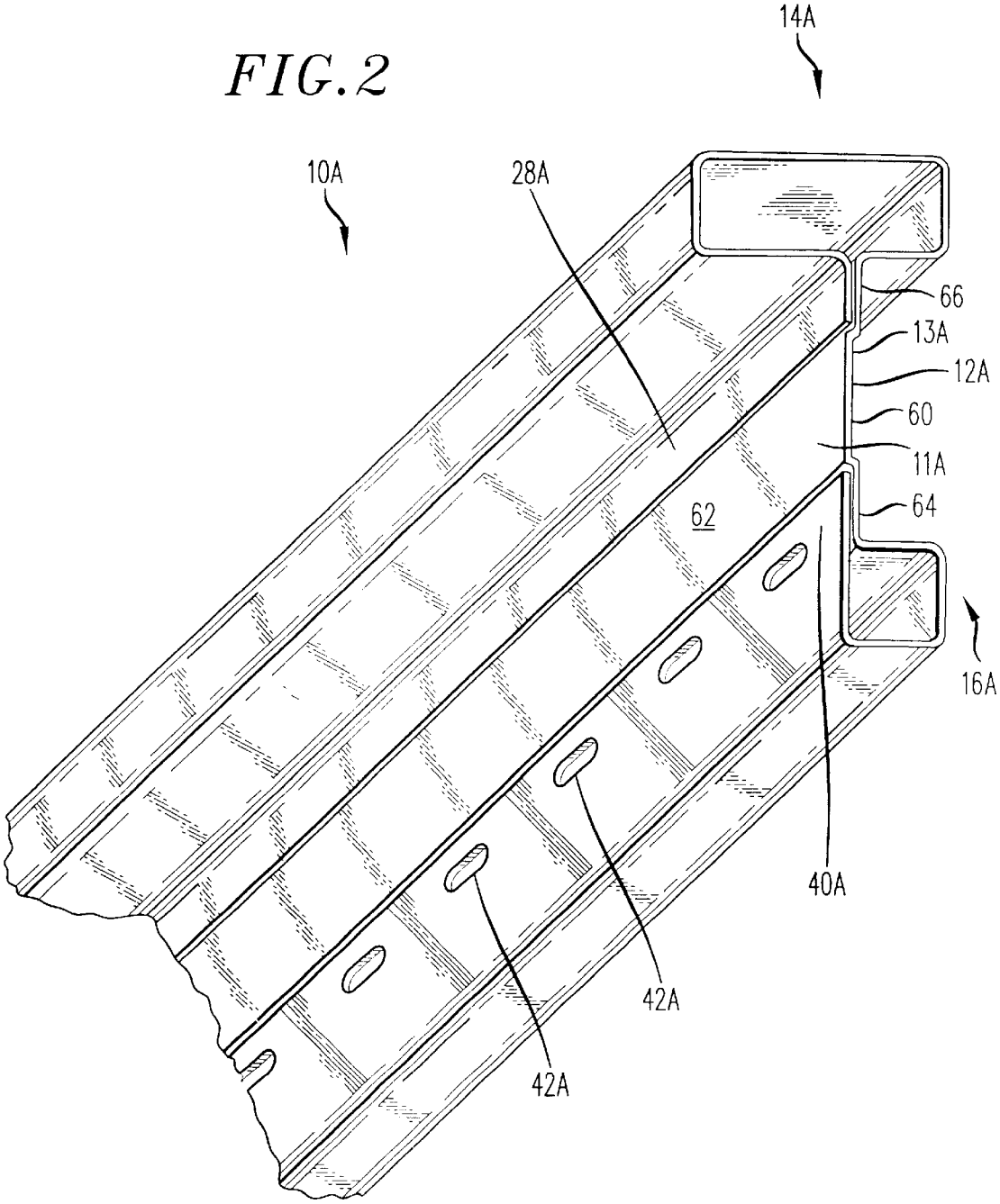
FIG. 2 is a partial prospective end view of a second embodiment of the metal structural member.

FIG. 2 is a second embodiment of the structural member of FIG. 1 referred to as 10A. Structural member 10A is identical with respect to the structural member 10 as illustrated in FIG. 1 with the exception of the web 12A profile and lower flange 16A. As illustrated in FIG. 2, web 12A has a first side 11A and a second side 13A. In the forming process, web 12A is formed with a longitudinal protrusion 60 on side 11 resulting in a raised surface 62 and two recessed surfaces 64 and 66. The protrusion 60 is preferrably at a height equal to the thickness of the galvanized steel being utilized to form the structural metal member 10A. In this configuration, the margins 28A of flange 14A and the margin 40A of flange 16A are juxtaposed against the recess surfaces 64 and 66 of side llA of web 12A. Margin 40A of flange 16A would be secured to the web 12A by suitable fastener means 42A. In this configuration, flange 16A is formed such that its margin 40A is on the same side, side 11A of web 12A as the margin 28A of upper flange 14A.

Structural member 10A can be used in a similar fashion to that of structural member 10 as illustrated in FIG. 3. In this instance, the intermediate structural members 50 and 52 when installed, would insure that the margins 28A and 40A would be juxtaposed against the recessed surfaces 64 and 66 and the intermediate members would be juxtaposed against the margins 28A and 40A and the raised surface 62, thus providing for increased load bearing support.

While the present invention has been described with respect to the preferred embodiments thereof, will be recognized by those of ordinary skill in the art that many changes and modifications may be made without departing from the spirit and scope of the invention. Therefore the invention is intended to be limited only by the scope of the claims and the equivalence thereof.

We claim:

1. A cold-formed, sheet metal, elongate structural member comprising:

a web member having a first side and a second side to longitudinally extending edges;

a first hollow flange member extending along one said edge and projecting laterally to both sides of said web, said first hollow flange member being rectangular in cross section;

a second hollow flange member extending along the opposing said edge of said web and said second hollow flange member projecting laterally to one side of said web, each of said hollow flange members having a margin formed thereon, said margin juxtaposed said web, one of said margins being fastened to said web, wherein said first side of said web is centrally, elongately stepped forming longitudinal straps adjacent said edges for receipt of said margins of said first hollow flange member and said second hollow flange member said web being stepped a height equal to the thickness of said cold formed metal used in fabricating said structural member.

2. The cold-formed, sheet metal, elongate structural member in accordance with claim 1 wherein said first hollow flange member projects to a greater extent to said first side of said web than to said second side of said web.

3. The cold-formed, sheet metal, elongate structural member in accordance with claim 2 wherein said first hollow flange member extends to said first side of said web and said second side of said web in a ratio of 2:1.

4. The cold-formed, sheet metal, elongate structural member in accordance with claim 1 wherein said second hollow flange member extends to said second side of said web, a distance equal to the distance of extension of said first hollow flange member on said second side of said web.

* * * * *